US006558298B2

(12) United States Patent
Fields et al.

(10) Patent No.: US 6,558,298 B2
(45) Date of Patent: May 6, 2003

(54) TRAINING BAG

(75) Inventors: Sarah Fields, Oklahoma City, OK (US); L. Michael Dillard, Midwest City, OK (US); Danny M. Bower, Norman, OK (US)

(73) Assignee: Century Incorporated, Oklahoma City, OK (US)

( * ) Notice: Subject to any disclaimer, the term of this patent is extended or adjusted under 35 U.S.C. 154(b) by 6 days.

(21) Appl. No.: 09/753,423

(22) Filed: Jan. 3, 2001

(65) Prior Publication Data

US 2002/0086776 A1 Jul. 4, 2002

(51) Int. Cl.[7] ..... A63B 69/20; A63B 69/22
(52) U.S. Cl. ..... 482/87; 482/86
(58) Field of Search ..... 482/83, 86, 87; 473/441, 442; 273/DIG. 20

(56) References Cited

U.S. PATENT DOCUMENTS 6,106,443 A * 8/2000 Kuo ..... 482/83
6,234,940 B1 * 5/2001 Fotsis ..... 482/83
6,251,051 B1 * 6/2001 Chen ..... 482/83

* cited by examiner

*Primary Examiner*—Nicholas D. Lucchesi
*Assistant Examiner*—Fenn Mathew
(74) *Attorney, Agent, or Firm*—Dunlap Codding & Rodgers

(57) ABSTRACT

A training bag including a first bladder, a second bladder, and flexible outer shell is provided. The first bladder is fabricated of a flexible, water impervious material and defines a water chamber for holding a selected quantity of water. The second bladder is fabricated of a flexible, air impervious material defines an air chamber. The second bladder has a central cavity in which the first bladder is positioned such that the second bladder is concentrically positioned about the first bladder. The second bladder is inflatable by passing pressurized air into the air chamber. The outer shell is positioned about the first and second bladders.

10 Claims, 4 Drawing Sheets

TRAINING BAG

BACKGROUND OF THE INVENTION

1. Field of the Invention

The present invention relates generally to bags which are struck with an individual's hands, feet, and legs for fitness and technique training for activities such as boxing and martial arts, and more particularly, but not by way of limitation, to an improved training bag which includes an inner liquid filled chamber and an outer air filled chamber thereby allowing the firmness and weight of the training bag to be easily adjusted while permitting the training bag to be collapsed for easy transport.

2. Brief Description of the Related Art

Various types of bags have long been employed by boxers and practitioners of martial arts, such as karate, for training purposes. Small, lightweight bags are typically used to improve an individual's reflexes, hand speed, and punching accuracy. However, such lightweight bags do not accurately simulate the type of reaction that is obtained when striking a human opponent, as in a boxing or karate match. As such, bags commonly referred to as "heavy bags" have long been used to simulate the size and weight of an opponent.

Heavy bags have been constructed in various ways. A common construction has been to pack a flexible casing with cotton fiber material and a quantity of sand to give the bag the desired weight and impact absorption characteristics. While these types of bags are effective training devices, once these bags are manufactured, their size and weight make them difficult for an individual to transport.

To this end, a need exists for an improved training bag which is easy to transport and which permits the firmness and weight of the bag to be easily adjusted. It is to such a training bag that the present invention is directed.

BRIEF SUMMARY OF THE INVENTION

The present invention is directed to a training bag. The training bag includes a first bladder, a second bladder, and flexible outer shell. The first bladder is fabricated of a flexible, water impervious material and defines a water chamber for holding a selected quantity of water. The second bladder is fabricated of a flexible, air impervious material defines an air chamber. The second bladder has a central cavity in which the first bladder is positioned such that the second bladder is concentrically positioned about the first bladder. The second bladder is inflatable by passing pressurized air into the air chamber. The outer shell is positioned about the first and second bladders.

The features and advantages of the present invention will become apparent from the following detailed description when read in conjunction with the accompanying drawings and appended claims.

DETAILED DESCRIPTION OF THE INVENTION

Figure 1:
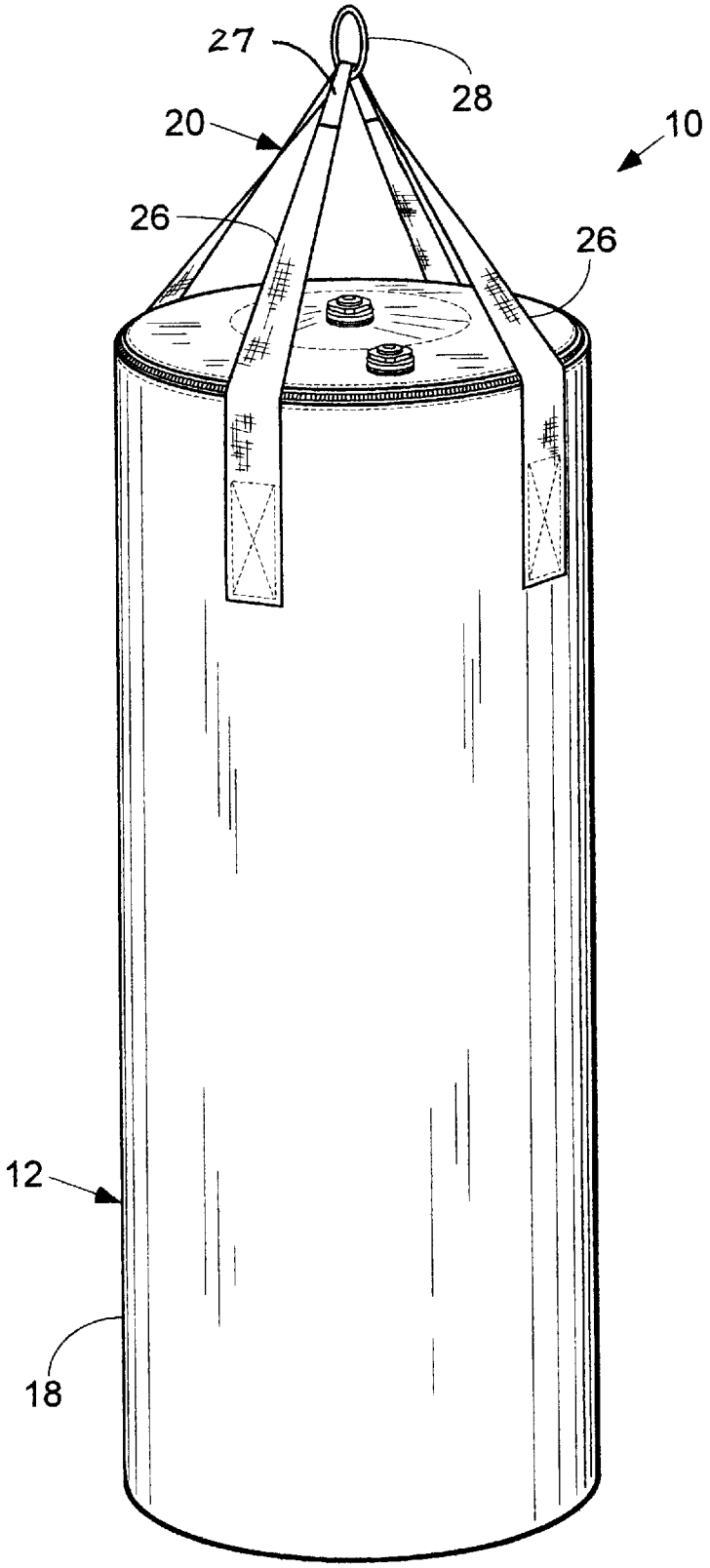
FIG. 1 is a perspective view of a training bag constructed in accordance with the present invention.
Figure 2:
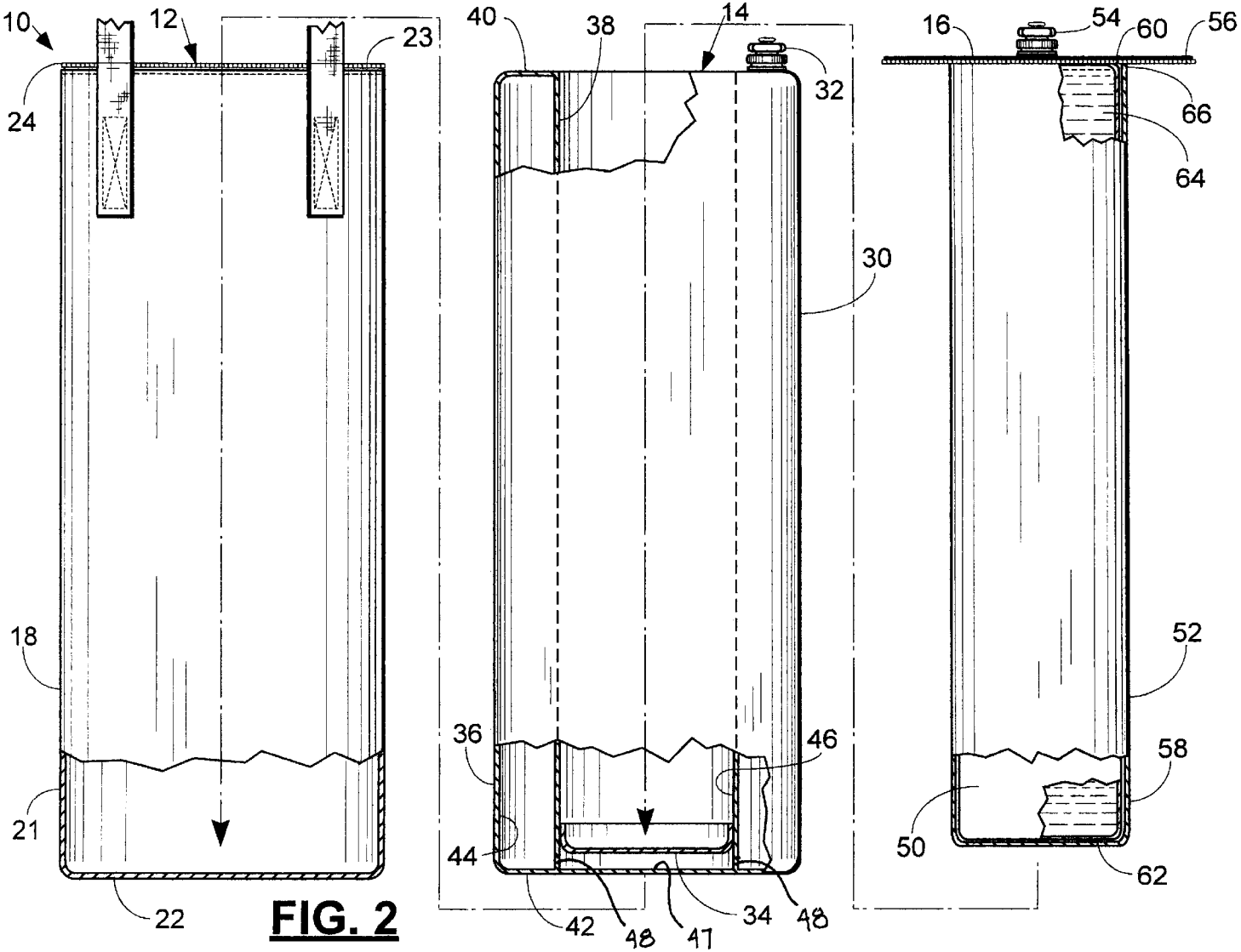
FIG. 2 is an exploded, side elevational view of the training bag of the present invention.

Referring now to the drawings, and more particularly to FIGS. 1 and 2, a training bag 10 constructed in accordance with the present invention is illustrated. The training bag 10 is substantially cylindrically shaped and includes an outer shell assembly 12, an air bladder assembly 14 for holding air under pressure, and a water bladder assembly 16 for holding a quantity of water.

The shell assembly 12 includes a body member 18 and a strap assembly 20. The body member 18 is a substantially cylindrically shaped bag having a sidewall 21, a closed bottom 22, and an open upper end 23 for receiving the air bladder assembly 14 and the water bladder assembly 16. The body member 18 is preferably constructed of a flexible, polyester vinyl of approximately 18 ounces per square yard in weight; however, it will be appreciated that other materials commonly used in the construction of "heavy bags" can be used. The open upper end 23 of the body member 18 is provided with a closure member, illustrated herein as a zipper portion 24, for attaching the water bladder assembly 16 to the body member 18 in a manner to be discussed in detail below.

As shown in FIG. 1, the strap assembly 20 includes a pair of straps 26 with vinyl reinforcements 27 and a hanging O-ring 28. The straps 26 are threaded through the O-ring 28, and the ends of the straps 26 are attached to the body member 18 substantially as shown in FIG. 1 with one of the straps 26 extending diametrically over the upper end 23 of the body member 18 and the other strap 26 extending diametrically over the upper end 23 of the body member 18 in a criss-cross relation with respect to the other strap 26. The ends of the straps 26 are attached to the body member 18 in a suitable manner such as by sewing. The O-ring 28 is adapted to be attached to a fixed support for supporting the training bag 10 in a suspended condition.

As shown in FIG. 2, the air bladder assembly 14 includes an air bladder 30, a valve 32, and a bottom support 34. The air bladder 30 has a substantially elongated, annular shape and has an outer wall 36, an inner wall 38, an upper wall 40, and a lower wall 42 all of which cooperate to define an air chamber 44. The inner wall 38 defines a central cavity 46 which extends the length of the air bladder 30. The upper wall 40 extends between the outer wall 36 and the inner wall 38 thereby leaving the upper end of the central cavity 46 open while the lower wall 42 extends over the entire lower end of the air bladder 30 thereby closing the lower end of the central cavity 46. The air bladder 30 is formed of a flexible, air impervious material. A suitable material is a 20 gauge polyvinyl chloride sheet. The outer wall 36 is configured to conform with the interior surface of the body member 18 when the air bladder 30 is inflated.

The valve 32 is disposed in the upper wall 40 of the air bladder 30 and is utilized to inflate the air bladder 30 by forcing air through the valve 32 and into the air chamber 44. The valve 32 is illustrated as being a Boston valve. However, those of ordinary skill in the art will appreciate that other types of valves can be used.

The bottom support 34 is a flexible piece of material attached to the inner wall 38 of the air bladder 30 so as to extend across the central cavity 46 a distance above the lower wall 42 of the air bladder 30. A suitable distance is approximately three inches. The bottom support 34 is the same type of material used to construct the air bladder 30 to facilitate heat sealing the bottom support 34 to the inner wall 38 of the air bladder 30 along a peripheral portion of the bottom support 34 to create a bottom air chamber 47. The bottom air chamber 47 is in fluid communication with the air chamber 46 via a plurality of holes 48 formed through the inner wall 38 of the air bladder 30. As will be discussed below, bottom air chamber 47 created by the bottom support 34 functions to support the water bladder assembly 16 so that the water bladder assembly 16 does not have a tendency to bulge the bottom of the training bag 10 when the training bag 10 is assembled and inflated for use.

Figure 3:
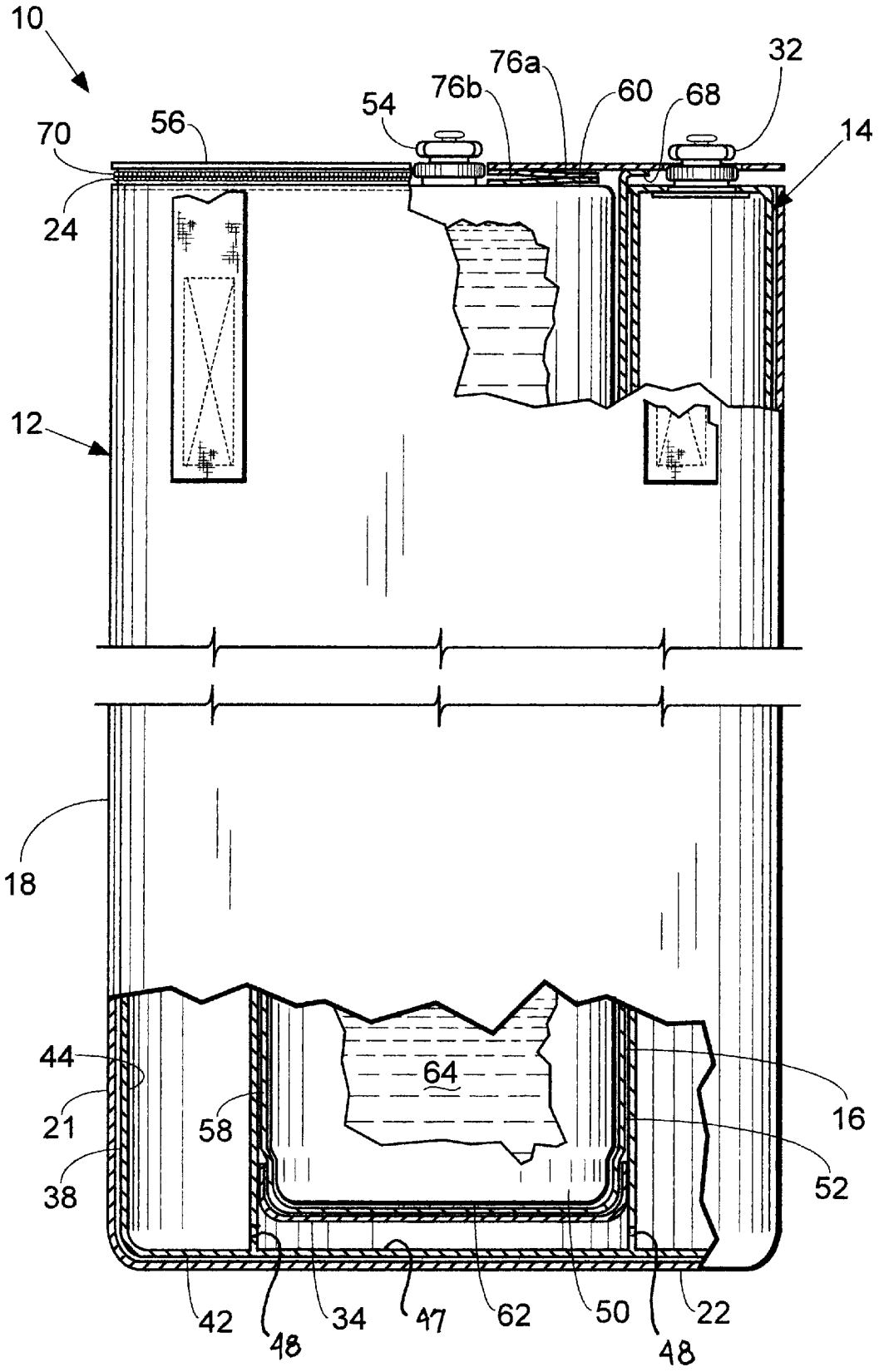
FIG. 3 is a partially cutaway, side elevational view of the training bag of FIG. 1.
Figure 4:
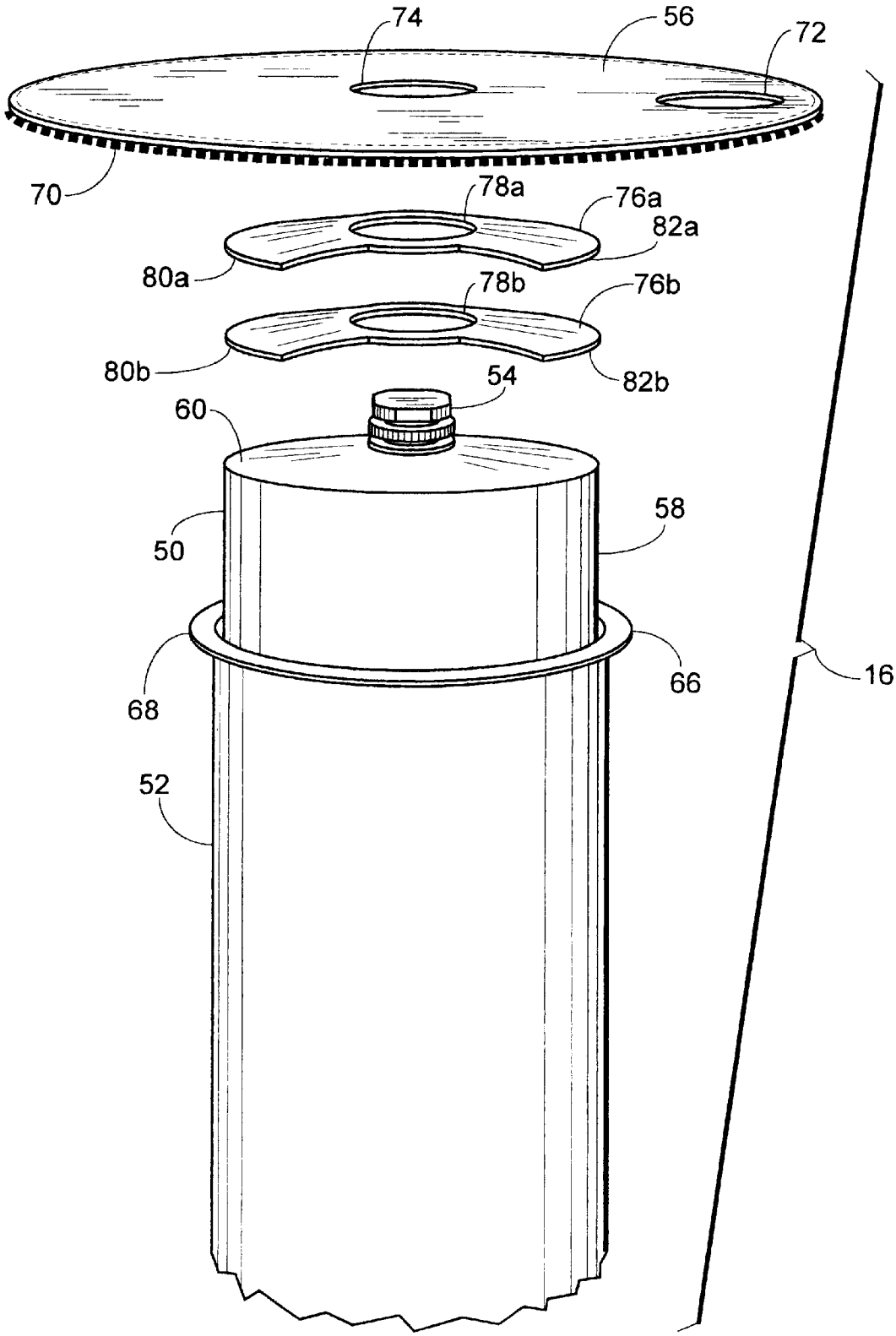
FIG. 4 is an exploded, perspective view of the water bladder assembly.

Referring now to FIGS. 2–4, the water bladder assembly 16 includes a water bladder 50, a bladder support cover 52, a valve 54, and a lid member 56. The water bladder 50 is a substantially cylindrically shaped bag having a sidewall 58, an upper wall 60, and a bottom wall 62, all of which cooperate to define a water chamber 64 for holding a selected amount of water or other suitable liquid. As best shown in FIG. 2, the length of the water bladder 50 is less than the length of the air bladder 30 a sufficient amount so that length of the water bladder 50 is approximately the same distance as between the bottom support 34 of the air bladder assembly 14 and the upper wall 40 thereof. The water bladder 50 is formed of a flexible, water impervious material. A suitable material is a 20 gauge polyvinyl chloride. The water bladder 50 is preferably sized to have a capacity of approximately 8 gallons of water whereby the water bladder assembly 16 will weigh approximately 70 pounds when the water chamber 64 is filled to capacity. However, it should be understood that the size and shape of the various components of the training bag 10 may be varied to produce training bags of different sizes and weight capacities.

The valve 54 is centrally disposed in the upper wall 60 of the water bladder 50 and is utilized to fill the water bladder 50 with a desired amount of water. Like the valve 32, the valve 54 is illustrated as being a Boston valve. However, those of ordinary skill in the art will appreciate that other types of valves can be used.

To ensure that the water bladder 50 is sufficiently supported when filled with water to capacity, the water bladder 50 is enclosed within the bladder support cover 52 and the lid member 56. The bladder support cover 52 is a substantially cylindrically shaped bag having an open upper end 66 for receiving the water bladder 50. The bladder support cover 52 is constructed of a flexible, polyester vinyl and is sized such that the sidewall 58 and the bottom wall 62 of the water bladder 50 conform to the contour of the inner surface of the water bladder support cover 52 when the water bladder 50 is filled with water. The open upper end 66 of the bladder support cover 52 is provided with an annular lip 68 (FIGS. 3 and 4) which is used to attach the upper end 66 of the bladder support cover 52 to the lid member 56.

The lid member 56 is a circularly shaped member constructed of a flexible, polyester vinyl and sized such that the outer peripheral edge corresponds with the upper end 23 of the body member 18 of the shell assembly 12. More specifically, the lid member 56 is provided with a zipper portion 70 which is adapted to be mated with the zipper portion 24 of the body member 18 for securing the lid member 56 to the body member 18 whereby the lid member 56 cooperates with the body member 18 to form an outer shell of the training bag 10. To this end, the lid member 56 is preferably constructed of the same material used to construct the body member 18 of the outer shell assembly 12. As best shown in FIG. 4, the lid member 56 is also provided with a pair of openings 72 and 74 for receiving the valves 32 and 54, respectively.

To further support the water bladder 50 when the water bladder 50 is filled with water, the upper wall 60 of the water bladder 50 is attached to the lower side of the lid member 56, as best shown in FIG. 3. The water bladder 50 is preferably attached to the lid member 56 with a pair of flexible connector flaps 76*a* and 76*b* (FIGS. 3 and 4). The connector flap 76*a* is constructed of a flexible, polyester vinyl and is substantially butterfly shaped with a central opening 78*a* formed therethrough for receiving the valve 54 and a pair of oppositely disposed tabs 80*a* and 82*a*. The connector flap 76*a* is attached to the lower side of the lid member 56 in a suitable manner, such as by forming an annular heat seal between the connector flap 76*a* and the lower side of the lid member 56 near the central opening 78*a* as shown in FIG. 3. Likewise, the connector flap 76*b* is constructed of a flexible, polyester vinyl and is substantially butterfly shaped with a central opening 78*b* formed therethrough for receiving the valve 54 and a pair of oppositely disposed tabs 80*b* and 82*b*. The connector flap 76*b* is attached to the upper wall 60 of the water bladder 50 in a suitable manner, such as by forming an annular heat seal between the connector flap 76*b* and the upper wall 60 of the water bladder 50 near the central opening 78*b* with the tabs 80*a* and 82*a* of the connector flap 76*a* aligned with the tabs 80*b* and 82*b* of the connector flap 76*b*. The corresponding tabs 80*a* and 80*b* are then connected to one another near their outer ends and the corresponding tabs 82*a* and 82*b* are connected to one another near their outer ends, thereby providing a flexible connection between the water bladder 50 and the lid member 56.

Referring now to FIG. 3, to assemble the training bag 10, the water bladder 50 of the water bladder assembly 16 is positioned in the central cavity 46 of the air bladder assembly 14 with the air bladder 30 and the water bladder 50 deflated whereby the air bladder 30 is concentrically positioned about the water bladder 50. The combination of the air bladder assembly 14 and the water bladder assembly 16 is then disposed in the body member 18 of the shell assembly 12. It will be appreciated that one of the advantages of the training bag 10 is that when the air bladder 30 and the water bladder 50 are deflated, the training bag 10 is easily folded into a relatively compact unit due to the flexibility of the materials used to construct the training bag 10 thereby facilitating transportation of the training bag 10.

To inflate the training bag 10 for use, the training bag 10 is initially laid out flat with the zipper portions 24 and 70 connected so that the air bladder 30 and the water bladder 50 are lying flat within the body member 18 and so that the valve 32 of the air bladder assembly 14 is aligned with the opening 72 of the lid member 56. The air bladder 30 is next partially inflated with a conventional air pump (not shown) to give the air bladder 30 some structural integrity.

The training bag 10 is next positioned in an upright position and the water bladder 50 filled with water via the valve 54 using a conventional water hose (not shown). The water bladder 50 is filled with water until the desired weight of the training bag 10 is achieved. As stated above, the water bladder 50 illustrated herein is sized such that the water bladder 50 has a capacity of approximately eight gallons of water and thus will weigh approximately 70 pounds when filled to capacity. It will be appreciated, however, that the training bag 10 can be constructed in a variety of different sizes so as to alter the capacity of the training bag 10 by altering the overall length of the various components of the training bag 10.

With the water bladder 50 filled to the desired level, the air bladder 30 is further inflated until the desired firmness of the training bag 10 is achieved. Consequently, the water bladder assembly 16 provides the desired weight to the training bag 10 while the air bladder assembly 14 provides the desired impact absorption characteristics without requiring additional padding on the inner side of the body member 18 of the outer shell assembly 12 which would diminish the collapsibility of the body member 18, although additional padding can be employed if desired. Upon suspending the training bag 10 from a support member, the training bag 10 is ready to be struck within a strike zone defined by the sidewall 21 of the body member 18 of the outer shell assembly 12. The training bag 10 is easily disassembled by first removing the air from the air bladder 30 and then removing the water from the water bladder 50.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A training bag, comprising:

a first bladder constructed of a collapsible, water impervious material, the first bladder having an upper end and a lower end;

a quantity of water disposed in the first bladder to fill the first bladder and provide the first bladder with a selected weight;

a second bladder constructed of a collapsible air impervious material and positioned substantially about the first bladder;

a quantity of air disposed within the second bladder to inflate the second bladder to achieve a selected firmness;

a flexible outer shell disposed about the first and second bladders, the outer shell including a body member and a lid member selectively detachable from the body member; and a strap assembly extending from the outer shell for suspending a combination of the outer shell, the first bladder, and the second bladder from a support member, wherein the upper end of the first bladder is connected to the lid of the outer shell.

2. The training bag of claim 1 wherein the second bladder has a central cavity for receiving the first bladder, the cavity having an open upper end and a closed lower end, and wherein the bottom of the first bladder is supported a distance above the lower end of the second bladder.

3. The training bag of claim 1 further comprising a bladder support cover disposed about the first bladder and having an upper end connected to the lid of the outer shell.

4. The training bag of claim 1 wherein the first bladder further includes a valve for passing the water into the first bladder, the valve extendable through the outer shell.

5. The training bag of claim 1 wherein the second bladder further includes a valve for passing the air into the second bladder, the valve extendable through the outer shell.

6. A training bag, comprising:

a first bladder fabricated of a flexible, water impervious material, the first bladder defining a water chamber for holding a selected quantity of water, the first bladder having an upper end and a lower end;

a second bladder fabricated of a flexible, air impervious material and defining an air chamber, the second bladder having an upper end, a lower end, an inner wall, and an outer wall, the second bladder being inflatable by passing pressurized air into the air chamber, the second bladder positioned about the first bladder;

a flexible outer shell positioned about the first and second bladders, the outer shell including a body member and a lid member selectively detachable from the body member; and a strap assembly extending from the outer shell for suspending a combination of the outer shell, the first bladder, and the second bladder from a support member, wherein the upper end of the first bladder is connected to the lid of the outer shell.

7. The training bag of claim 6 wherein the second bladder has a central cavity for receiving the first bladder, the cavity having an open upper end and a closed lower end, and wherein the bottom of the first bladder is supported a distance above the lower end of the second bladder.

8. The training bag of claim 6 further comprising a bladder support cover disposed about the first bladder and having an upper end connected to the lid of the outer shell.

9. The training bag of claim 6 wherein the first bladder further includes a valve for passing the water into the first bladder, the valve extendable through the outer shell.

10. The training bag of claim 6 wherein the second bladder further includes a valve for passing the air into the second bladder, the valve extendable through the outer shell.

* * * * *

UNITED STATES PATENT AND TRADEMARK OFFICE

CERTIFICATE OF CORRECTION

PATENT NO. : 6,558,298 B2
DATED : May 6, 2003
INVENTOR(S) : Sarah Fields and Danny M. Bower It is certified that error appears in the above-identified patent and that said Letters Patent is hereby corrected as shown below:

Title page,
Item [56], References Cited, U.S. PATENT DOCUMENTS, add the following:

| | | |
|---|---|---|
| -- 4,103,889 | Lobur | 08/01/1978 |
| 4,185,821 | Piccini | 01/29/1980 |
| 4,527,796 | Critelli | 07/09/1985 |
| 5,624,358 | Hestilow | 04/29/1997 -- |

Column 4,
Line 28, add the following paragraph:

-- With the water bladder 50 attached to the lower side of the lid member 56 and the water bladder 50 inserted into the water bladder support cover 52, the lip 68 of the water bladder support cover 52 is attached to the lower side of the lid member 56 in a suitable manner, such as by sewing, thereby enclosing the water bladder 50 within the water bladder support cover 52 and the lid member 56. --

Signed and Sealed this

Eighteenth Day of May, 2004

JON W. DUDAS
*Acting Director of the United States Patent and Trademark Office*